US011798753B2

(12) United States Patent
Moore

(10) Patent No.: US 11,798,753 B2
(45) Date of Patent: Oct. 24, 2023

(54) HANDSET FOR CONTROLLING A SURGICAL OPERATING TABLE

(71) Applicant: Eschmann Holdings Limited, Lancing (GB)

(72) Inventor: Colin Moore, Lancing (GB)

(73) Assignee: Steris Solutions Limited, Leicester (GB)

( * ) Notice: Subject to any disclaimer, the term of this patent is extended or adjusted under 35 U.S.C. 154(b) by 619 days.

(21) Appl. No.: 17/044,431

(22) PCT Filed: Apr. 3, 2019

(86) PCT No.: PCT/EP2019/058407
§ 371 (c)(1),
(2) Date: Oct. 1, 2020

(87) PCT Pub. No.: WO2019/193054
PCT Pub. Date: Oct. 10, 2019

(65) Prior Publication Data

US 2021/0035749 A1 Feb. 4, 2021

(30) Foreign Application Priority Data

Apr. 5, 2018 (GB) ..... 1805651

(51) Int. Cl.
*H01H 9/02* (2006.01)
*A61G 13/08* (2006.01)

(52) U.S. Cl.
CPC ..... *H01H 9/0235* (2013.01); *A61G 13/08* (2013.01); *A61G 2203/12* (2013.01)

(58) Field of Classification Search
CPC ..... H01H 9/0235; A61G 13/08
(Continued)

(56) References Cited

U.S. PATENT DOCUMENTS 5,710,398 A 1/1998 Hassler et al.
6,351,678 B1 * 2/2002 Borders ..... G16H 20/30 700/83

(Continued)

FOREIGN PATENT DOCUMENTS

EP 1321121 A1 6/2003
WO 96/26615 8/1996

OTHER PUBLICATIONS

International Preliminary Report on Patentability in related international application No. PCT/2019/058407 dated Oct. 6, 2020.

(Continued)

*Primary Examiner* — Yong Hang Jiang
(74) *Attorney, Agent, or Firm* — Polsinelli, P.C.

(57) ABSTRACT

A handset for controlling a surgical operating table, the handset having a three-dimensional physical representation of a tabletop of a surgical operating table, the physical representation of the tabletop comprising a back section, a seat section and one or more leg sections, wherein at least one of the sections includes a respective sensor arranged to sense a force or movement applied to a surface of the respective section by a touch applied to the surface, and a control system within the handset which is connected to the sensor, the control system being arranged to generate an output control signal for transmission to the surgical operating table to be controlled in response to an input command of an applied force or applied movement sensed by the respective sensor. Methods of controlling a tabletop of a surgical operating table using the handset are also disclosed.

26 Claims, 4 Drawing Sheets

(58) Field of Classification Search
USPC ..... 340/4.31
See application file for complete search history.

(56) References Cited

U.S. PATENT DOCUMENTS

| | | | | |
|---|---|---|---|---|
| 2003/0195644 | A1* | 10/2003 | Borders | A61G 12/00 340/568.1 |
| 2007/0107126 | A1* | 5/2007 | Koch | A61G 13/02 5/600 |
| 2009/0267897 | A1* | 10/2009 | Ootsuka | G08C 17/02 341/20 |
| 2012/0118718 | A1 | 5/2012 | Geiger et al. | |
| 2013/0096701 | A1* | 4/2013 | Suorajaervi | A61G 13/08 700/83 |
| 2016/0095773 | A1* | 4/2016 | Ruch | A61G 13/04 5/616 |
| 2018/0008052 | A1* | 1/2018 | Krickeberg | A61G 15/10 |

OTHER PUBLICATIONS

Combined Search and Examination Report in related GB application No. 1805651.5 dated Oct. 5, 2018.
International Search Report and Written Opinion issued in related international application No. PCT/EP2019/058407 dated May 29, 2019.

* cited by examiner

HANDSET FOR CONTROLLING A SURGICAL OPERATING TABLE

FIELD OF THE INVENTION

The present invention relates to a handset for controlling a surgical operating table. The present invention relates to a method for controlling a surgical operating table using a handset.

BACKGROUND

Surgical tables, or operating tables, have a variety of different well known configurations, for example comprising a base for standing on a floor, a column extending from the base, and a tabletop providing a patient support surface. There is a general need in the art for surgical tables to have variable height to enable the tabletop to be located at a defined height which is most suitable for the required surgical, therapeutic or diagnostic treatment of a patient positioned on the surgical table. The column is extendable, typically by a telescoping arrangement, to allow the column to be moved between contracted and extended positions in order to lower and/or raise the tabletop to a desired height. In other surgical tables, an arm, instead of a column, can lower and/or raise the tabletop to the desired height. Still further, the tabletop of the surgical table is generally required to be movable relative to the column or arm so as to be tiltable about two orthogonal horizontal axes, namely a tilt axis extending longitudinally along the length of the tabletop and a trend axis extending transversely across the length of the tabletop.

In addition, the tabletop generally includes a number of independently movable segments. For example a head section, one or more torso sections and one or more leg sections.

It is well known to provide a handset to enable the various movement functions of the surgical operating table to be controlled. The handset may be, connected by a wired connection, or wirelessly connected, to the surgical operating table to be able to send movement commands to the table. Known handsets for controlling surgical operating tables typically comprise many push buttons associated with a variety of icons, and/or text. The icons and text are used to identify the movement available to the respective push button.

The most-used push buttons tend to be located in an array conveniently positioned for manual control. Examples of the most-used push buttons are: HEAD UP, HEAD DOWN, LEG UP, LEG DOWN, BACK UP, BACK DOWN, SLIDE CRANIALLY, SLIDE CAUDALLY, TREND, REVERSE TREND, AUTO LEVEL. Other functions may be "KIDNEY UP", "KIDNEY DOWN", "FLEX", REFLEX" etc. Lesser used functions may be available on a display screen, often several menu layers down.

These known handsets suffer from the problem that it can be time consuming and difficult for the healthcare operator to search for and select a push button, from the many push buttons provided, often in a small dimension array, to activate a desired movement of the table. Furthermore, the manual pressing of the selected button to activate the desired movement does not provide any significant visual, audible or touch feedback to the user. In addition, the speed of motion of the selected segment or the table is difficult to control or adjust using the push button. Typically, small adjustments to a selected movement requires the selection of another push button.

Furthermore, there is a possibility that the wrong button may be inadvertently pressed, which may raise a major safety concern. It is often difficult for a user to read and correctly interpret small buttons printed with manufacturer's icons, particularly when the icons may differ between handsets and different manufacturers. Pressing a button on a handset may provide little or no feedback or facility to adjust the speed of movement of the controlled segment of the surgical operating table.

There is a need in the art to provide a handset, in particular a handset for controlling a surgical operating table, which has a more ergonomic design than known handsets, and in particular can more easily and/or more controllably enable movement commands to be readily selected for transmission to the device to be controlled.

SUMMARY OF THE INVENTION

The present invention provides a handset for controlling a surgical operating table, the handset comprising a three-dimensional physical representation of a tabletop of a surgical operating table, the physical representation of the tabletop comprising a back section, a seat section and one or more leg sections, wherein at least one of the sections includes a respective sensor arranged to sense a force or movement applied to a surface of the respective section by a touch applied to the surface, and a control system within the handset which is connected to the sensor, the control system being arranged to generate an output control signal for transmission to the surgical operating table to be controlled in response to an input command of an applied force or applied movement sensed by the respective sensor.

The present invention further provides a method of controlling a surgical operating table, the method comprising the steps of:

a. providing a handset comprising a three-dimensional physical representation of a tabletop of a surgical operating table, the physical representation of the tabletop comprising a back section, a seat section and one or more leg sections;
b. applying a force or movement by touch to a surface of one of the sections of the physical representation;
c. sensing the applied force or applied movement as an input command; and
d. generating an output control signal for transmission to the surgical operating table to be controlled in response to the input command.

The present invention further provides a handset for controlling a surgical operating table, the handset comprising a three-dimensional physical representation of a tabletop of a surgical operating table, at least one orientation sensor which is adapted to detect the orientation of the handset or the physical representation in three-dimensional space, and a control system within the handset which is connected to the at least one orientation sensor, the control system being arranged to generate an output control signal for transmission to the surgical operating table to be controlled in response to an input command sensed by the at least one orientation sensor, wherein the control system is configured to generate the output control signal to move, or cause the movement of, the surgical operating table to be controlled in response to the detected orientation of the handset or physical representation in three-dimensional space.

The present invention further provides a method of controlling a surgical operating table, the method comprising the steps of:

a. providing a handset comprising a three-dimensional physical representation of a tabletop of a surgical operating table;

b. detecting the orientation of the handset or the physical representation in three-dimensional space, the detection being by at least one orientation sensor;

c. providing an input command corresponding to the detected orientation; and d. generating an output control signal for transmission to the surgical operating table to be controlled in response to the input command, the output control signal moving, or causing the movement of, the surgical operating table to be controlled in response to the detected orientation of the handset or physical representation in three-dimensional space.

The handset and method of the preferred embodiments provide a number of advantages over known handsets.

In the preferred embodiments of the present invention, the handset is shaped to resemble the shape of the surface or device to be moved and adjusted. The handset therefore comprises a three dimensional physical representation, for example in the form of a model, of the device, or part of the device, to be controlled. Parts of the handset are preferably movable, and flexibly mounted, so as to be able to move in the same orientation and direction as the surface or device to be moved and adjusted. Sensors in the handset detect applied force or movement, to cause switches to generate a movement request by a control system. The individual sensors and switches can be associated with illumination devices such as LEDs to provide a visual feedback on selection. The illumination devices can also be arranged to provide a visual feedback on movement, close to the limit status, failure status, etc. The illumination devices can be arranged to be extinguished after a preset time-out period. The illumination devices may be illuminated to provide a constant, intermittent flashing or dimming illumination to provide additional visual information to the user. The handle may be provided with a trigger mechanism to provide a speed control for the selected movement.

The control system includes software that controls the handset, and interprets the switch positions as determined by the sensors and handset controls to generate command signals which are transmitted, by a wired connection or wirelessly, to the device to be controlled. A part of the device to be controlled which is represented by the three-dimensional physical representation in the handset which is touch controlled by application of force or movement to a surface thereof is repositioned according to the transmitted command signal.

The handset of the preferred embodiments of the present invention can be safely controlled by a user in a surgical or other medical environment. A desired part of the three-dimensional physical representation in the handset is touched or moved to select a desired movement of a selected element of the device, or the entire device. If moved, after release the selected part returns to its original central position under a bias. The selected part in the handset is highlighted by illumination of the illumination device to confirm its selection. The trigger is then enabled and the trigger is then moved, for example by pressing, to cause movement at a desired speed which is controlled by controlling the level of pressure on the trigger. Release of the trigger returns the trigger to its original position and terminates movement. The selected table movement is deselected after a time-out period, and the illumination device is extinguished.

In the preferred embodiments of the present invention, the three-dimensional physical representation of the tabletop of a surgical operating table, comprises a central seat section and on opposite sides thereof a back section and one or two leg sections. The central seat section may be fitted to a handle. The back section and one or two leg sections are movable in an up or down direction to cause biased switches to detect the selected up or down movement of the selected section. Pressing the back section or the leg section causes the respective tabletop section of the surgical operating table to move in a corresponding direction. The speed of the selected motion in the tabletop can be varied by varying the pressure applied to the section of the three-dimensional physical representation. The three-dimensional physical representation may also comprise one or more sensors to detect the application of a tilting force or movement about a longitudinal axis extending along the three-dimensional physical representation; such sensors can be used to control a TILT motion of the tabletop section of the surgical operating table.

In the preferred embodiments of the present invention, other operating controls are used to initiate and control other movement functions of the tabletop of the surgical operating table. For example, SLIDE, HEIGHT and TREND movements may be controlled by control buttons in a handle fitted to the three-dimensional physical representation of the tabletop. The control buttons can select the desired movement, and then speed can be controlled by a trigger mechanism. Alternatively, the TREND motion may be controlled by trend control buttons provided on the upper surface of the three-dimensional physical representation of the tabletop, for example on a seat portion, which may be fitted to a handle, or a movable back portion. Alternatively, the SLIDE and/or HEIGHT motion may be controlled by manual application of a corresponding force or motion on the three-dimensional physical representation of the tabletop, with some or more additional sensors arranged for detecting horizontal or vertical force/motion applied to the three-dimensional physical representation of the tabletop.

Other compound movements of the surgical operating table, for example FLEX, REFLEX, and CHAIR, may be controlled by selecting the required motion on a touchscreen or other interface provided on the upper surface of the three-dimensional physical representation of the tabletop, for example on a seat portion, which may be fitted to a handle, or a movable back portion. Such a touchscreen could also provide TREND and/or TILT control.

In some embodiments of the present invention, the orientation of the handset or the physical representation in three-dimensional space is detected by at least one orientation sensor. This causes, directly or indirectly, the surgical operating table to be moved to a position determined in response to the detected orientation of the handset or physical representation in three-dimensional space. This control system can, for example, provide control of the TREND and/or TILT functions of the surgical operating table. Typically, the at least one orientation sensor is calibrated so that the selected motion is only selected after a minimum threshold movement in three-dimensional space (for example, a minimum rotation of 30 degree about a given rotational axis) has been exceeded, so that accidental movements are eliminated or at least minimized. In these embodiments incorporating at least one orientation sensor, a second manual action, for example the use of a trigger, is used to cause the signal to be generated, in order to be transmitted to the device to be controlled.

The handset therefore may preferably further comprise at least one orientation sensor which is adapted to detect the orientation of the handset or the physical representation in three-dimensional space, wherein the output control signal relates to the detected orientation of the handset or physical representation in three-dimensional space, and the handset is configured to generate the output control signal after a manual control operation to move, or cause the movement of, the surgical operating table to be controlled in response to the detected orientation of the handset or physical representation in three-dimensional space.

The at least one orientation sensor and control system may be configured to control the Trendelenburg movement and/or tilt movement of the surgical operating table to be controlled.

The handset may further comprise a manual control which is activatable to cause the control system to generate the output control signal, after detection of the orientation of the handset or the physical representation in three-dimensional space, to move, or cause the movement of, the surgical operating table to be controlled in response to the detected orientation of the handset or physical representation in three-dimensional space by operation of the manual control.

The manual control may include a trigger mechanism which is configured, when the trigger mechanism is manually depressed, to cause the control system to generate the output control signal to move, or cause the movement of, the surgical operating table to be controlled in response to the detected orientation of the handset or physical representation in three-dimensional space.

The trigger mechanism is typically configured to function as a speed control for movement of the surgical operating table by the output control signal, the degree of depression of the trigger mechanism corresponding to a speed of movement of the surgical operating table in three-dimensional space.

Therefore in some embodiments, entire tabletop may be moved by operating a touchscreen on the physical representation, by operating a control button on the physical representation or the handle, or by using one or more orientation sensors, for example in the form of accelerometers, in the handle which detect the orientation of the physical representation in three-dimensional space. The trigger may be used to control the speed of movement.

For example, the SLIDE and HEIGHT movements of the tabletop may be controlled by selecting the required movement function by operating the touchscreen or by operating a control button. One or more LEDs may be illuminated to confirm the selected movement function. The trigger is then squeezed to control the speed. Release of the trigger terminates the movement, which may be confirmed by the one or more LEDs being extinguished.

In another example, the rotational movements of the tabletop, for example REVERSE TREND, TREND, TILT LEFT, or TILT RIGHT, may be controlled by selecting the required movement function by operating the touchscreen or by operating a control button. One or more LEDs may be illuminated to confirm the selected movement function. The trigger is then squeezed to control the speed. Release of the trigger terminates the movement, which may be confirmed by the one or more LEDs being extinguished.

In an alternative example, the rotational movements of the tabletop, for example REVERSE TREND, TREND, TILT LEFT, or TILT RIGHT may be controlled by manually orienting the handset in three-dimensional space so as to orient the physical representation in three-dimensional space in the desired orientation of the surgical operating table which is being controlled, the movement being confirmed for example by illumination devices or by the touchscreen, and then squeezing the trigger to initiate movement. Again, one or more LEDs may be illuminated to confirm the selected movement function. The degree of trigger squeeze can control the speed. Release of the trigger terminates the movement, which may be confirmed by the one or more LEDs being extinguished.

Additional movements of the surgical operating table may be controlled by operating the touchscreen or by operating a control button. For example, specific movements such as LEVEL (to move the tabletop to a level horizontal position), CHAIR (to move the tabletop to a position resembling a chair having a seated position), FLEX (to move the tabletop to a position where the centre of the tabletop is higher than the two ends), and REFLEX (to move the tabletop to a position where the centre of the tabletop is lower than the two ends), which may require more than one table segment to be moved simultaneously, may be controlled by dedicated touchscreen icons or control buttons. The selected movement may be selected prior to squeezing the trigger to initiate the motion and to control the speed of the selected motion. In the preferred embodiments of the present invention, the handset appears to a user to resemble a "table on handle" in which the movement of a table segment or section mimics the motion of the corresponding real-life surgical operating table. This greatly simplifies the user interface for the operating table, and avoids undesired or inadvertent movements by operation of the handset. The physical representation of the tabletop may be rotatably fitted to the handle, so that the physical representation of the tabletop may be rotated to any desired orientation relative to the handle which is held in the hand. The handset may readily be held by the handle so that, for example, the head end of the physical representation is toward the user, which replicates the view of an anesthetist during use of the surgical operating table. Alternatively, the head end of the physical representation may be rotated to any other desired position relative to the handle. In other embodiments, the handle may be configured to rotate, for example at a point part (e.g. one third) of the way down the handle, which provides a simplified manufacture. The action of rotating the handle may be configured to select a desired Patient Orientation for the surgical operating table. Illumination devices, for example LEDs, may be provided in the head section, and/or the leg section(s), to indicate the selected Patient Orientation.

The speed control for a selected motion may be conducted by squeezing a trigger on the handle, which is a widely familiar control mechanism. The ergonomic design of the preferred embodiments is convenient for left-handed or right-handed use, and can be used in a single-handed operation. The handle shape enables the handset readily to be placed securely and stably on a surface. The handset may be wireless and may include a rechargeable battery pack.

BRIEF DESCRIPTION OF THE DRAWINGS

Embodiments of the present invention will now be described by way of example only with reference to the accompanying drawings, in which.

DETAILED DESCRIPTION

Figure 1:
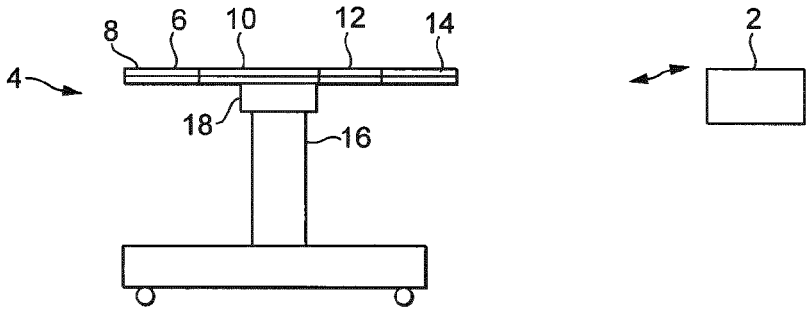
FIG. 1 is a schematic side view of a handset according to an embodiment of the present invention in combination with a surgical operating table to be controlled by the handset.
Figure 2:
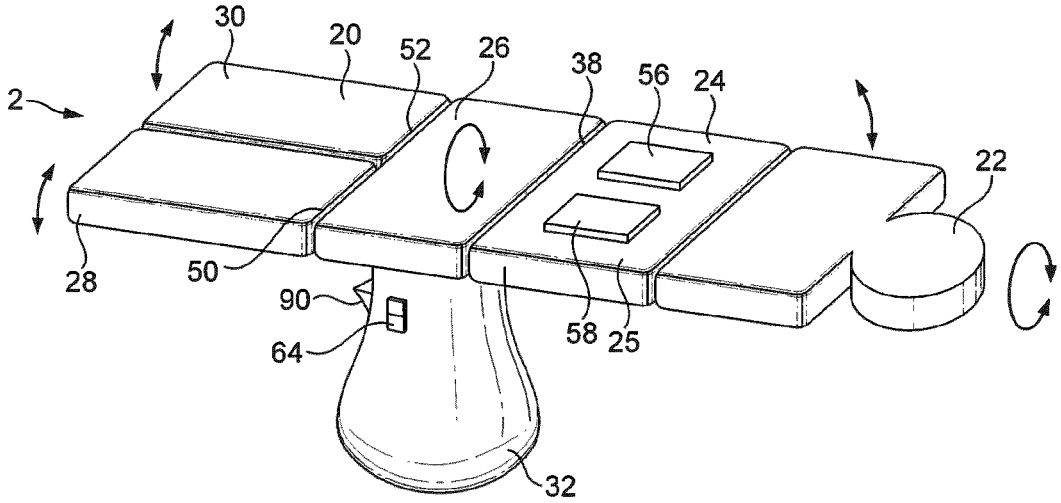
FIG. 2 is a schematic perspective view of the handset of FIG. 1.
Figure 3:
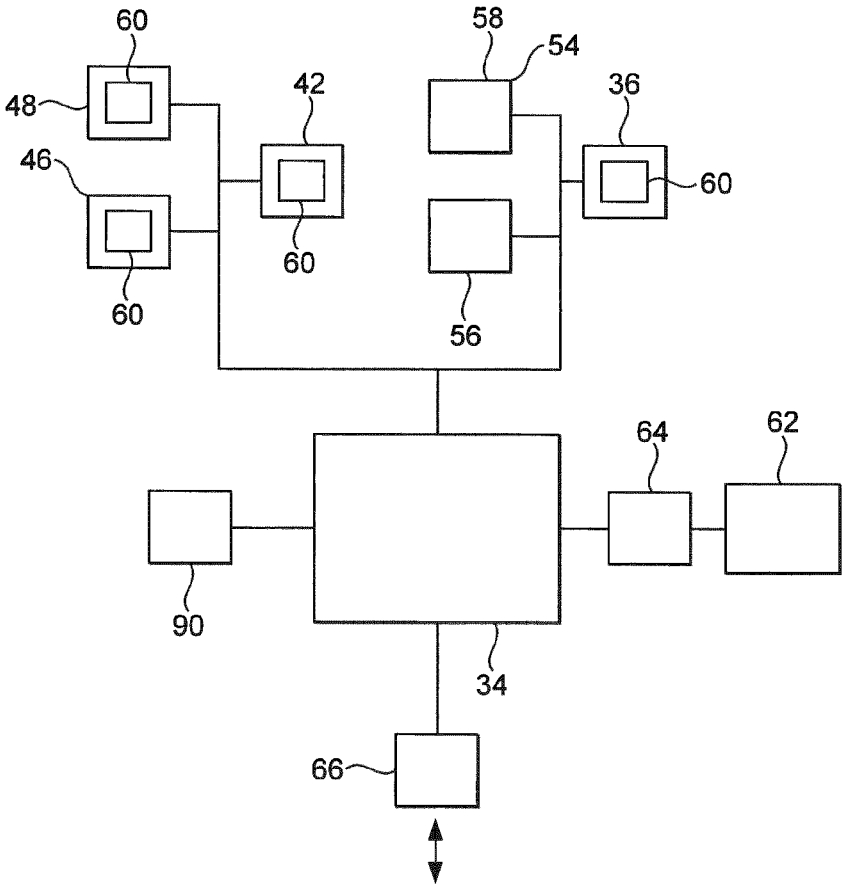
FIG. 3 is a schematic drawing of the hardware in the handset of FIG. 1.

Referring to FIGS. 1 to 3, there is shown a handset 2 according to an embodiment of the present invention. The handset 2 is configured for controlling a device having a plurality of movable elements or parts, in particular a surgical operating table 4.

Any suitable surgical operating table configuration may be utilized in conjunction with the handset 2 of the present invention, provided that the function of the surgical operating table 4 correlates with the functional control provided by the handset 2. In one example as shown in FIG. 1, the surgical operating table 4 has movable elements which comprise segments of a tabletop 6 of the surgical operating table 4. In this example, these segments comprise a head section 8, an upper body section 10, a lower body section 12 and one or two leg sections 14 (some persons skilled in the art of surgical operating tables may alternatively call these segments a head section 8, a back section 10, a seat section 12 and one or two leg sections 14). The movable elements also comprise a column 16 on which the tabletop 6 is mounted; however, other surgical tables incorporate an arm instead of a column for raising and lowering the tabletop 6. A mechanism, generally indicated by reference numeral 18, is provided in the surgical operating table 4 which can be controlled to incline the tabletop 6 in a Trendelenburg position, in which the entire tabletop 6 is inclined so that the head section 8 is lowered relative to the other sections of the tabletop 6, and a Reverse Trendelenburg position, in which the entire tabletop 6 is inclined so that the head section 8 is raised relative to the other sections of the tabletop 6, by rotating the tabletop 6 about a transverse trend axis extending across the tabletop 6. The mechanism 8 also can be controlled to tilt the tabletop 6 by rotating the tabletop 6 about a longitudinal tilt axis extending along the tabletop 6.

Drive mechanisms are provided within the surgical operating table 4 to move the tabletop 6 to a desired position or configuration according to a command from the handset 2. Typically, the handset 2 is adapted to control the surgical operating table 4 by wireless communication, although a wired connection may alternatively be employed. The handset 2 is adapted translationally and/or rotationally to move individual segments of the tabletop 6 or the entire tabletop 6.

Thus, individual segments of the tabletop 6 or the entire tabletop 6 can be translationally moved in a vertical orientation, i.e. in an upward direction or a downward direction; the entire tabletop 6 can be translationally moved in a horizontal orientation, i.e. in a direction extending from the head section 8 to the one or two leg sections 14 or in an opposite direction; and/or the entire tabletop 6 can be rotationally moved about the transverse trend axis and/or the longitudinal tilt axis.

The handset 2 comprises a three-dimensional physical representation 20 of a tabletop of a surgical operating table. The physical representation 20 of the tabletop comprises a back section 24, a seat section 26 and one or more leg sections 28, 30. The physical representation is mounted on a handle 32. The seat section 24 is fitted to the handle 32. The seat section 26 is adjacent to the back section 24 on one side of the back section 24. A head portion 22 of the back section 2 is rigidly fitted to a body portion 25 of the back section 24. The one or more leg sections 28, 30 are fitted to the other side of the seat section 26.

At least one of the sections 24 to 30 includes a respective sensor arranged to sense a force or movement applied to a surface of the respective section by a touch applied to the surface. A control system 34 within the handset 2 is connected to the sensor. The control system 34 is arranged to generate an output control signal for transmission to the surgical operating table 4 to be controlled in response to an input command of an applied force or applied movement sensed by the respective sensor.

In particular, the back section 24, either in the head portion 22 or body portion 25 of the back section 24, includes a first sensor 36, which may comprise a plurality of individual sensor elements each arranged to sense a respective force or movement. The first sensor 36 is adapted to sense an upward or downward force or movement applied by touch to the back section 24. The control system 34 is adapted respectively to generate a back up or back down output control signal in response thereto.

In the illustrated embodiment of the present invention, the back section 24 is movable relative to the adjacent seat section 26 in an upward or downward direction, and the first sensor 36 is adapted to sense upward and downward movement of the back section 24. The back section 24 is fitted to the adjacent seat section 26 by a first flexible or bendable connection 38 therebetween to permit the back section 24 to be movable relative to the adjacent seat section 26 in an upward or downward direction. The first flexible or bendable connection 38 may be a hinge. Preferably, the back section 24 is movable about a central position and is biased towards the central position.

In the illustrated embodiment of the present invention, each of the leg sections 28, 30 includes a respective second sensor 46, 48 which is adapted to sense an upward or downward force or movement applied to the respective leg section 28, 30. Each second sensor 46, 48 may comprise a plurality of individual sensor elements each arranged to sense a respective force or movement The control system 34 is adapted respectively to generate a leg up or leg down output control signal in response thereto.

In the illustrated embodiment, the physical representation 20 of the surgical operating table comprises two leg sections 28, 30 which are located adjacent to each other on opposite sides of a longitudinal axis of the physical representation 20 and each leg section 28, 30 comprises a respective second sensor 46, 48 to sense an upward or downward force or movement applied to the respective leg section 28, 30. In an alternative embodiment, there is only one leg section with a single sensor.

Each leg section 28, 30 is independently movable relative to the adjacent seat section 26 in an upward or downward direction, and the second sensor 46, 48 is adapted to sense upward or downward movement of the at least one leg section 28, 30. Each leg section 28, 30 is fitted to the adjacent seat section 26 by a respective flexible or bendable connection 50, 52 therebetween to permit the leg section 28, 30 to be independently movable relative to the adjacent seat section 26 in an upward or downward direction. The flexible or bendable connection 50, 52 may be a second hinge. Preferably, each leg section 28, 30 is movable about a central position and is biased towards the central position.

In the illustrated embodiment of the present invention, the seat section is fitted to the handle 32. In the embodiment, the seat section 26 includes a third sensor 42 which is adapted to sense a rotational force or movement applied, in either of two opposite rotational directions about a longitudinal axis of the physical representation 20, by touch to the seat section 26. The third sensor 42 may comprise a plurality of individual sensor elements each arranged to sense a respective force or movement. The control system 34 is adapted respectively to generate a table tilt output control signal, the table tilt output control signal representing the same rotational direction as the applied rotational force or movement, in response thereto.

The seat section 26 may be fixed to the handle 32, and the tilt force applied thereto may be detectable by the third sensor 42 without requiring any movement of the seat section 26. Alternatively, the seat section 26 may be rotatably fitted to the handle 32, and able to rotate about a central longitudinal axis, so that the tilt force applied to the seat section 26 may be detectable by the third sensor 42 which detects rotational tilting movement of the seat section. Preferably, the rotatable seat section 26 is movable about a central position and is biased towards the central position.

The seat section 26 may be fixed or rotatable, relative to the adjacent back section 24 and leg sections 28, 30, about a longitudinal axis of the physical representation 20.

In an alternative embodiment, the back section 24 may additionally or alternatively be rotatable, or able to detect a rotational force, relative to the adjacent seat section 26 in opposite rotational directions about a longitudinal axis of the physical representation 20, and the first sensor 36 may be adapted to sense rotational movement of the back section 24. The back section 24 may be fitted to the adjacent seat section 26 by a second flexible or bendable connection therebetween to permit the back section 24 to be rotated relative to the adjacent seat section 26 in opposite rotational directions.

Each of the first, second and third sensors 36, 46, 48, 42, is preferably coupled to an illumination device 60, such as a light emitting diode (LED), which is illuminated when the respective sensor senses a force or movement as described above. This provides a visual feedback that the force or motion has been sensed to cause a control signal to be generated to transmission to the surgical operating table 4.

The illumination devices 60 can also be arranged to provide a visual feedback on movement, close to the limit status, failure status, etc. The illumination devices 60 can be arranged to be extinguished after a preset time-out period. The illumination devices 60 may be illuminated to provide a constant, intermittent flashing or dimming illumination to provide additional visual information to the user.

Each of the first, second and third sensors 36, 46, 48, 42, functions as a switch which detects selection of a desired movement function and enables a corresponding part of the surgical operating table 4 to be controlled to be moved by the handset 2.

In the illustrated embodiment of FIG. 2, the handle 32 is substantially cylindrical, although it may have any other desired cross-sectional shape. The handle 32 extends downwardly from the physical representation 20. Typically, the handle 32 comprises a stand for the handset 2, and has a flat lower surface, which enables the handset 2 to be stood stably and securely on a surface. Typically, an electrical power supply 62, such as a rechargeable battery pack, is located in the handle 32. The electrical power supply 62 may be provided with an external connector (not shown) to enable the handset to receive power or to be charged; alternatively, the electrical power supply 62 may be charged wirelessly, for example by providing a charging stand for charging the electrical power supply 62 inductively. An ON/OFF power switch 64, which can be configured to operate the surgical table and/or the handset 2, is located on the handle 32. The control system 34 is connected to an emitter 66 for wirelessly emitting an output control signal to the surgical operating table 4 to be controlled. Alternatively, a wired connection may be provided.

The handle 32 is provided with a trigger mechanism 90 to provide a speed control for the selected movement. After the respective first, second or third sensor 36, 46, 48, 42, has functioned as a switch which has detected selection of a desired movement function and enabled a corresponding part of the surgical operating table 4 to be controlled to be moved by the handset 2, depressing of the trigger mechanism 90 causes the selected part of the surgical operating table 4 to be moved at a speed controlled by the degree of pressure applied to, or the degree of depression of, the trigger mechanism 90. After release of the trigger mechanism 90, the trigger mechanism 90 returns to its original position and the motion of the selected part of the surgical operating table 4 is terminated. Although the term trigger mechanism is used herein, this term encompasses any physical control which may be manually manipulated to control speed of movement of the selected part of the surgical operating table 4 and, for example when released, can be controlled to terminate the movement.

A switch mechanism 54 may be provided on at least one of the sections of the physical representation 20. In the illustrated embodiment, the switch mechanism 54 is on back section 24, in particular on the body portion 25 of the back section 24.

FIG. 2 shows an embodiment in which the switch mechanism 54 comprises a first physical switch 56 which is configured to control the Trendelenburg movement in a first rotational direction and a second physical switch 58 which is configured to control the Reverse Trendelenburg movement in a second, opposite, rotational direction. The physical switches may be control buttons.

The switch mechanism 54 is arranged, when manually switched, to cause the control system 34 to generate an output control signal for transmission to the surgical operating table 4 to be controlled to control a Trendelenburg movement of the surgical operating table 4 about an axis transverse to a longitudinal axis of the surgical operating table 4.

In use, the handset 2 is used in a method of controlling the surgical operating table 4.

The handset 2 comprises a three-dimensional physical representation 20 of a tabletop of a surgical operating table. The physical representation 20 of the tabletop comprises the back section 24, including head portion 22 and body portion 25 rigidly fitted together, seat section 26 and one or more leg sections 28,30. In the method, a force or movement is applied by touch to a surface of one of the sections of the physical representation 20. The applied force or applied movement is sensed as an input command. An output control signal is generated for transmission to the surgical operating table 4 to be controlled in response to the input command. For example, an applied touching force on the back section 24, which preferably moves the back section 24, is sensed by the first sensor 36 which senses an upward or downward force or movement applied by touch to the back section 24 to generate a back up or back down output control signal in response thereto.

In another example, the first sensor 36 may sense a rotational force or movement applied, in either of two opposite rotational directions about a longitudinal axis of the physical representation 20, by touch to the back section 24 to generate in step d a table tilt output control signal, the table tilt control signal representing the same rotational direction as the applied rotational force or movement, in response thereto. When the back section 24 is movable in an upward or downward direction, relative to the adjacent seat section 26, which is typically fitted to the handle 32, the first sensor 36 is adapted to sense upward or downward movement of the back section 24.

Additionally or alternatively, correspondingly, the third sensor 42 in seat section 26, if provided, senses a rotational force or movement applied, in either of two opposite rotational directions about a longitudinal axis of the physical representation 20, by touch to the seat section 26, to generate a table tilt output control signal. The table tilt output control signal represents the same rotational direction as the applied rotational force or movement, in response thereto.

When the seat section 26 is rotatable, relative to the handle 32, about a longitudinal axis of the physical representation 20, the third sensor 42 senses rotational movement of the rotatable seat section 26.

Correspondingly, the second sensor 46, 48 in each leg section 28, 30 senses an upward or downward force or movement applied to the respective leg section 28, 30 to generate a leg up or leg down output control signal in response thereto. When each leg section 28, 30 is movable relative to the adjacent seat section 26 in an upward or downward direction, the respective second sensor 46, 48 senses upward or downward movement of respective leg section 28, 30.

As described, above only one leg section may optionally be provided, and with a single second sensor.

As also described above, each of the first, second and third sensors 36, 46, 48, 42, may be coupled to an illumination device 60, such as a light emitting diode (LED), which is illuminated when the respective sensor senses a force or movement as described above. This provides a visual feedback that the force or motion has been sensed to cause a control signal to be generated to transmission to the surgical operating table 4. Each of the sections of the physical representation 20 which are provided with the respective first, second and third sensors 36, 46, 48, 42, namely the back section 24, the leg sections 28, 30, and seat section 26, typically has a respective illumination device 60, such as a light emitting diode (LED), embedded in the respective section.

In a modification, plural illumination devices 60 may be embedded in the respective section, each illumination device 60 being associated with a respective force and a respective illumination colour. For example, an amber illumination device 60 could indicate an upward force or movement and a green illumination device 60 could indicate a downward force or movement. When the force or movement is sensed, the respective illumination device is illuminated to provide a visual feedback of the selected movement function for the surgical operating table 4. The illumination device 60 may be provided with a "time-out" function so that the illumination device 60 is extinguished after a given time delay. In alternative embodiments, a sound and/or vibration feedback may be provided by any suitable known sound emitter of vibration device, wither instead of or in combination with any illumination feedback.

Figure 4:
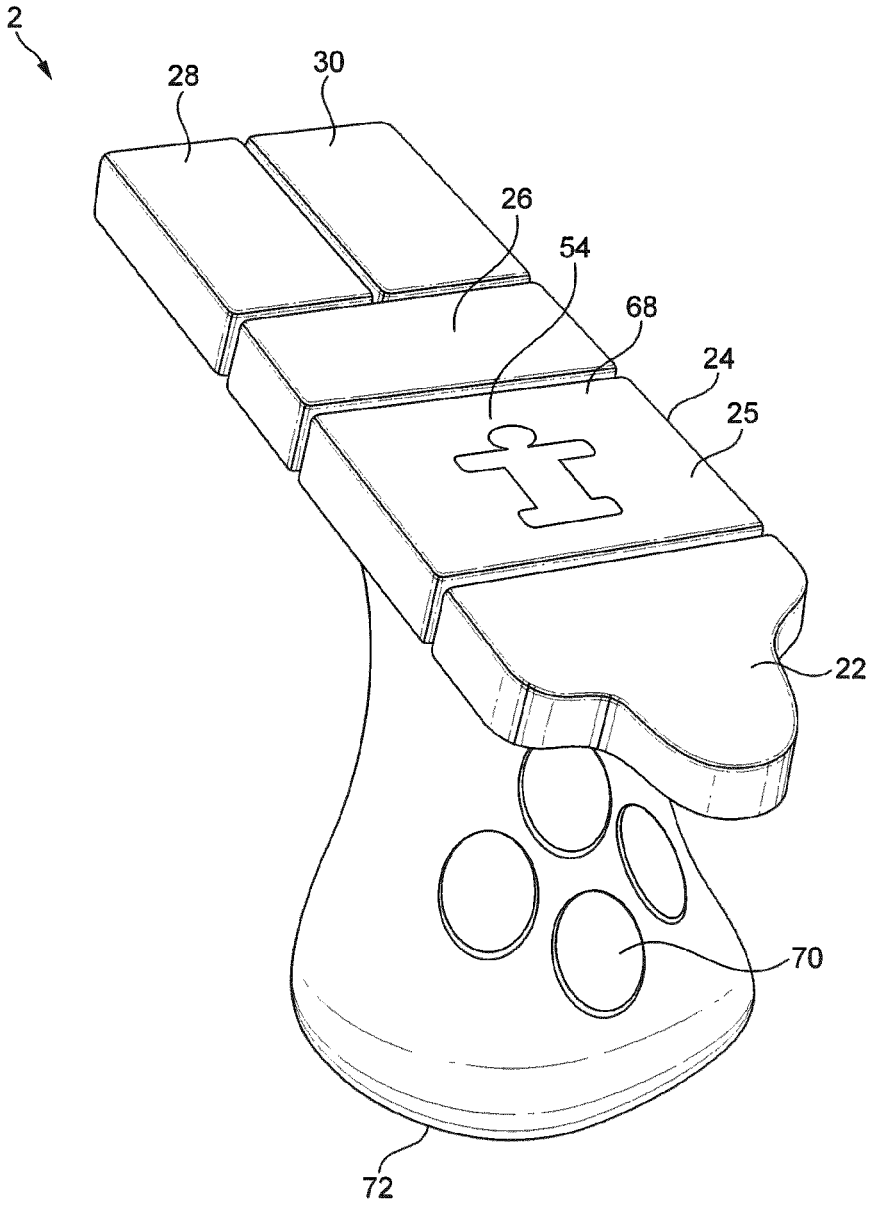
FIG. 4 is a schematic perspective view of a handset according to a second embodiment of the present invention.

In an alternative embodiment as illustrated in FIG. 4, the switch mechanism 54 comprises a touchscreen display 68. In this specification, the term "touchscreen display" is used in a broad sense to mean any device presenting the image of a screen with displayed icons which are touch sensitive. The touchscreen display may comprise a single unitary touchscreen device with displayed icons on a unitary screen and the touchscreen being touch sensitive so that pressing of the touchscreen in the vicinity of the icons activates a signal associated with the icon. Alternatively, the touchscreen display may comprise an array of plural individual displayed icons, each of which is associated with a respective switch device located beneath the respective icon.

In the alternative embodiment of FIG. 4, at least one control button 70 is located on the handle 72. The at least one control button 70 is arranged to cause the control system 34 to generate an output control signal for transmission to the surgical operating table 4 to be controlled to control a function of the surgical operating table 4. For example, the at least one control button 70 may be arranged to cause the control system 34 to generate a table tilt output control signal for transmission to the surgical operating table 4 to be controlled, the table tilt being about a longitudinal axis of the surgical operating table 4 to be controlled. With this arrangement, the back section 24 and leg sections 28, 30 of the representation 20 may only sense up and down motion and any rotational tilt control may be achieved by the control buttons 70.

Additionally or alternatively, the at least one control button 70 may be arranged to cause the control system 34 to generate a Trendelenburg output control signal for transmission to the surgical operating table 4 to be controlled to control a Trendelenburg movement of the surgical operating table 4 about an axis transverse to a longitudinal axis of the surgical operating table 4. With this arrangement, the switches 54 and touchscreen display 68 may optionally be omitted. The control buttons 70 may replace any buttons or touchscreen display on the representation 20. Alternatively, the touchscreen display 68 may be configured to control both tilt and Trendelenburg movement and direction.

The control buttons 70 on the handle 72, and/or the touchscreen display 68, are typically used to control movement in addition to the BACK UP/DOWN and LEG UP/DOWN movements controlled by the movable back section 24 and leg sections 28, 30 of the representation 20.

As described above, the control buttons 70 on the handle 72 and/or the touchscreen display 68 may be used to select a movement or position function, and then the motion, and typically its speed, may be controlled by using a trigger on the handle. For example, the SLIDE and HEIGHT movements of the tabletop may be controlled by selecting the required movement function by operating the touchscreen or by operating a control button. The trigger may then be squeezed to control the speed. Release of the trigger terminates the movement. Rotational movements of the tabletop, for example REVERSE TREND, TREND, TILT LEFT, or TILT RIGHT, may be controlled by selecting the required movement function by operating the touchscreen or by operating a control button. The trigger may then be squeezed to control the speed. Release of the trigger terminates the movement. Additional movements of the surgical operating table such as LEVEL, CHAIR, FLEX, and REFLEX may be controlled by operating the touchscreen or by operating control button, for example dedicated touchscreen icons or control buttons. The selected movement may be selected prior to squeezing the trigger to initiate the motion and to control the speed of the selected motion.

Figure 5:
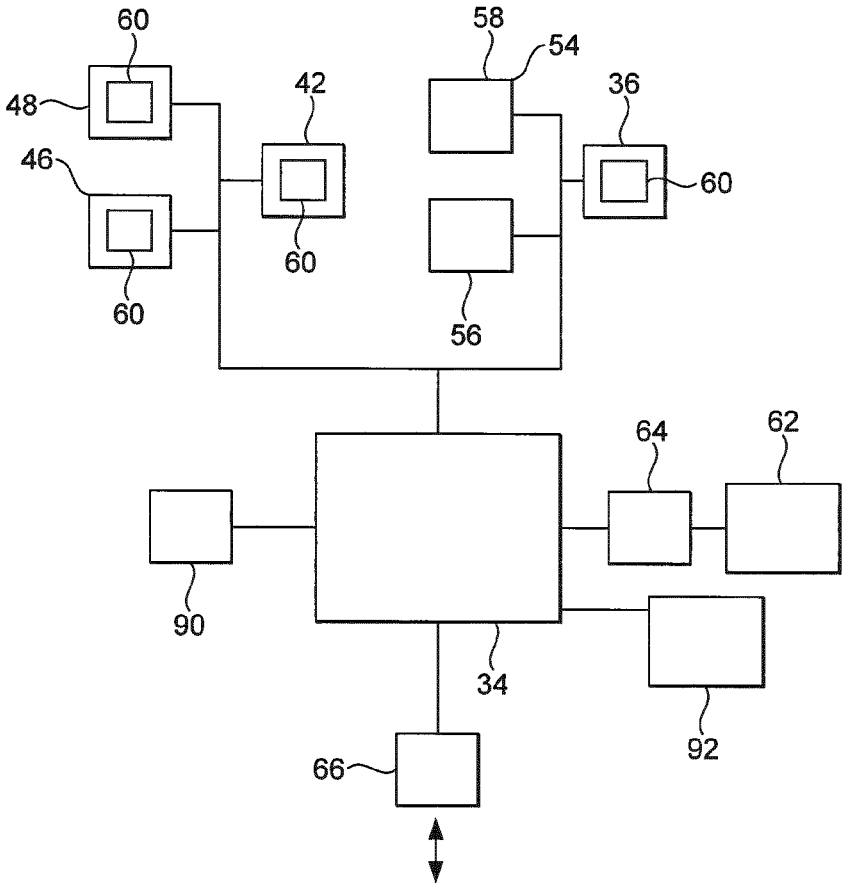
FIG. 5 is a schematic drawing of the hardware a handset according to a third embodiment of the present invention.

As described above, SLIDE, HEIGHT and TREND movements may be controlled by control buttons or a touchscreen display. Alternatively, the SLIDE and/or HEIGHT motion may be controlled by manual application of a corresponding force or motion on the three-dimensional physical representation of the tabletop, with some or more additional sensors arranged for detecting horizontal or vertical force/motion applied to the three-dimensional physical representation of the tabletop. FIG. 5 shows an alternative embodiment, which is a modification of the embodiment shown in FIG. 3, in which at least one orientation sensor, typically located in the handle, is configured to control the Trendelenburg movement and/or tilt movement.

In particular, an orientation sensor, preferably in the form of an accelerometer 92 for example, is located within the handle and is adapted to be able, together with the control system 34, to detect the orientation of the handset, in particular the physical representation, in three-dimensional space and to generate an output control signal to move, or cause the movement of, the surgical operating table which is being controlled in response to the detected orientation of the physical representation in three-dimensional space.

The rotational movements of the tabletop, for example REVERSE TREND, TREND, TILT LEFT, or TILT RIGHT are controlled by manually orienting the handset in three-dimensional space so as to move, or cause the movement of, the physical representation in three-dimensional space in the desired direction to achieve the desired orientation of the surgical operating table which is being controlled, the movement being confirmed for example by illumination devices or by the touchscreen, and then squeezing the trigger 90 to initiate movement.

The sensors 36, 42, 46, 48 may be provided as described above for the embodiment of FIG. 3. Alternatively, the sensors 36, 46, 48 may be configured only to detect upward and downward movement of the respective sections and there is no requirement for the sensor 42, or for the sensor 36, to be configured to detect rotational movement of the respective sections since such rotational movement is detected by the accelerometer 92 and used to control the Trendelenburg and tilt motion, each in respective opposite rotational directions, of the tabletop 6 of the surgical operating table 4 to be controlled.

Again, one or more LEDs 60 may be illuminated to confirm the selected movement function.

Trigger squeeze may initiate an input command to determine the orientation and generate, in real time, an output control signal to control the orientation of the table to be controlled to a corresponding orientation. The degree of trigger squeeze can control the speed. Release of the trigger 90 terminates the movement, which may be confirmed by the one or more LEDs 60 being extinguished.

Various modifications can be made to the above-described embodiments without departing from the scope of the present invention, which is defined by the claims.

The invention claimed is:

1. A handset for controlling a surgical operating table, the handset comprising a three-dimensional physical representation of a tabletop of a surgical operating table, the physical representation of the tabletop comprising a back section, a seat section and one or more leg sections, wherein at least one of the sections includes a respective sensor arranged to sense a force or movement applied to a surface of the respective section by a touch applied to the surface, and a control system within the handset which is connected to the sensor, the control system being arranged to generate an output control signal for transmission to the surgical operating table to be controlled in response to an input command of an applied force or applied movement sensed by the respective sensor;

wherein the back section includes a first sensor, wherein the first sensor is adapted to sense an upward or downward force or movement applied by touch to the back section, and the control system is adapted respectively to generate a back up or back down output control signal in response thereto;

wherein the first sensor is adapted to sense a rotational force or movement applied, in either of two opposite rotational directions about a transverse axis of the physical representation, by touch to the back section;

wherein the at least one leg section includes a second sensor, wherein the second sensor is adapted to sense an upward or downward force or movement applied to the at least one leg section, and the control system is adapted respectively to generate a leg up or leg down output control signal in response thereto; and wherein the second sensor is adapted to sense a rotational force or movement applied, in either of two opposite rotational directions about a transverse axis of the physical representation, by touch to the at least one leg section.

2. A handset according claim 1 wherein the back section is movable relative to an adjacent seat section in an upward or downward direction, and the first sensor is adapted to sense upward and downward movement of the back section.

3. A handset according to claim 2 wherein the back section is fitted to an adjacent seat section by a first flexible or bendable connection therebetween to permit the back section to be movable relative to the adjacent seat section in an upward or downward direction.

4. A handset according to claim 2 wherein the back section is movable about a central position and is biased towards the central position.

5. A handset according to claim 1 wherein the physical representation of the surgical operating table comprises two leg sections, which are located adjacent to each other on opposite sides of a longitudinal axis of the physical representation, and each leg section comprises a respective second sensor to sense an upward or downward force or movement applied to the respective leg section, and the control system is adapted respectively to generate a leg up or leg down output control signal in response thereto.

6. A handset according to claim 1 wherein the at least one leg section is movable relative to the seat section in an upward or downward direction, and the second sensor is adapted to sense upward or downward movement of the at least one leg section.

7. A handset according to claim 6 wherein the at least one leg section is fitted to the seat section by a second flexible or bendable connection therebetween to permit the at least one leg section to be movable relative to the adjacent seat section in an upward or downward direction.

8. A handset according to claim 6 wherein the at least one leg section is movable about a central position and is biased towards the central position.

9. A handset according to claim 1 further comprising a switch mechanism on at least one of the sections of the physical representation, the switch mechanism being arranged, when manually switched, to cause the control system to generate an output control signal for transmission to the surgical operating table to be controlled to control a Trendelenburg or Reverse Trendelenburg movement of the surgical operating table about an axis transverse to a longitudinal axis of the surgical operating table.

10. A handset according to claim 9 wherein the switch mechanism comprises a first switch which is configured to control the Trendelenburg movement in a first rotational direction and a second switch which is configured to control the Reverse Trendelenburg movement in a second, opposite, rotational direction.

11. A handset according to claim 1 further comprising at least one illumination device connected to the control system, wherein the control system is configured to illuminate the illumination device when a sensor senses a force or movement applied to a surface of a respective section by a touch applied to the surface.

12. A handset according to claim 11 wherein the control system is configured to extinguish the illumination of the illumination device after termination of generation of the output control signal.

13. A handset according to claim 1 further comprising at least one orientation sensor which is adapted to detect the orientation of the handset or the physical representation in three-dimensional space, wherein the output control signal relates to the detected orientation of the handset or physical representation in three-dimensional space, and the handset is configured to generate the output control signal after a manual control operation to move, or cause the movement of, the surgical operating table to be controlled in response to the detected orientation of the handset or physical representation in three-dimensional space.

14. A handset according to claim 13 wherein the at least one orientation sensor and control system are configured to control the Trendelenburg movement and/or tilt movement of the surgical operating table to be controlled.

15. A handset according to claim 13 further comprising a manual control which is activatable to cause the control system to generate the output control signal, after detection of the orientation of the handset or the physical representation in three-dimensional space, to move, or cause the movement of, the surgical operating table to be controlled in response to the detected orientation of the handset or physical representation in three-dimensional space by operation of the manual control.

16. A handset according to claim 15 wherein the manual control includes a trigger mechanism which is configured, when the trigger mechanism is manually depressed, to cause the control system to generate the output control signal to move, or cause the movement of, the surgical operating table to be controlled in response to the detected orientation of the handset or physical representation in three-dimensional space.

17. A handset according to claim 16 wherein the trigger mechanism is configured to function as a speed control for movement of the surgical operating table by the output control signal, the degree of depression of the trigger mechanism corresponding to a speed of movement of the surgical operating table in three-dimensional space.

18. A handset according to claim 13 wherein the control system is adapted to cause the output control signal to orient the surgical operating table to be controlled in an orientation corresponding to an orientation of the handset or physical representation in three-dimensional space.

19. A handset according to claim 13 wherein the orientation sensor comprises an accelerometer.

20. A handset according to claim 1 further comprising a handle, the physical representation of the surgical operating table being mounted on the handle.

21. A handset according to claim 20 wherein the seat section is fitted to the handle and the seat section is adjacent to the back section and/or the one or more leg sections.

22. A handset according to claim 20 wherein at least one control button is located on the handle, the at least one control button being arranged to cause the control system to generate an output control signal for transmission to the surgical operating table to be controlled to control a function of the surgical operating table.

23. A handset according to claim 22 wherein the at least one control button is arranged to cause the control system to generate a table tilt output control signal for transmission to the surgical operating table to be controlled, the table tilt being about a longitudinal axis of the surgical operating table to be controlled.

24. A handset according to claim 22 wherein the at least one control button is arranged to cause the control system to generate a Trendelenburg output control signal for transmission to the surgical operating table to be controlled to control a Trendelenburg movement of the surgical operating table about an axis transverse to a longitudinal axis of the surgical operating table.

25. A handset according to claim 20 further comprising a trigger mechanism on the handle, which is configured, when the trigger mechanism is manually depressed, to cause the control system to generate the output control signal.

26. A handset according to claim 25 wherein the trigger mechanism is configured to function as a speed control for movement of the surgical operating table by the output control signal, the degree of depression of the trigger mechanism corresponding to a speed of movement of the surgical operating table in response to the output control signal.

* * * * *